US006755167B2

(12) United States Patent
Krieg et al.

(10) Patent No.: US 6,755,167 B2
(45) Date of Patent: Jun. 29, 2004

(54) TWO-STEP ROLLER FINGER CAM FOLLOWER HAVING SPOOL-SHAPED LOW-LIFT ROLLER

(75) Inventors: John J. Krieg, Spencerport, NY (US); Timothy W. Kunz, Rochester, NY (US); Nick J. Hendriksma, Grand Rapids, MI (US); Wayne S. Harris, Hilton, NY (US); James A. Niemeier, Webster, NY (US); Jongmin Lee, Pittsford, NY (US); Hermes Fernandez, Rochester, NY (US); Joseph F. Girtler, Williamson, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/305,994

(22) Filed: Nov. 27, 2002

(65) Prior Publication Data

US 2003/0159666 A1 Aug. 28, 2003

Related U.S. Application Data

(60) Provisional application No. 60/359,744, filed on Feb. 26, 2002.

(51) Int. Cl.[7] ..... F01L 1/18

(52) U.S. Cl. ..... 123/90.39; 123/90.16; 74/569

(58) Field of Search ..... 123/90.15, 90.16, 123/90.17, 90.39, 90.4, 90.41, 90.42, 90.43, 90.44, 90.45, 90.46, 90.47; 74/569

(56) References Cited

U.S. PATENT DOCUMENTS 5,544,626 A * 8/1996 Diggs et al. ..... 123/90.16
5,960,756 A * 10/1999 Miyachi et al. ..... 123/90.16
6,302,075 B1 10/2001 Krieg et al.
6,321,705 B1 11/2001 Fernandez et al.
6,325,030 B1 12/2001 Spath et al.
6,439,179 B2 8/2002 Hendriksma et al.
6,463,897 B2 10/2002 Fernandez et al.
6,467,445 B1 10/2002 Harris
6,604,498 B2 8/2003 Fernandez et al.
6,615,782 B1 9/2003 Hendriksma et al.

* cited by examiner

*Primary Examiner*—Thomas Denion
*Assistant Examiner*—Jaime Corrigan
(74) *Attorney, Agent, or Firm*—Patrick M. Griffin

(57) ABSTRACT

A two-step roller finger follower including an elongate body having side walls defining coaxially disposed shaft orifices, a pallet end and a socket end interconnecting with the side walls to define a slider arm aperture, and a latch channel. The socket end is mountable to an hydraulic lash adjuster, and the pallet end is matable with a valve stem. A slider arm for engaging a high-lift cam lobe is disposed in the slider arm aperture and has a first end pivotably mounted to the pallet end of the body and the second end forming a slider tip for engaging an activation/deactivation latch. The latch is slidably disposed in the latch channel, and the latch has a nose section for selectively engaging the slider tip. A spool-shaped roller having first and second roller elements fixedly attached to the shaft is rotatably disposed in the shaft orifices, the roller being adapted to follow the surface motion of low-lift cam lobes. Preferably, the shaft is journalled in roller or needle bearings which extend between and through the first and second shaft orifices, being thus exposed to normal copious oil flow through the RFF.

17 Claims, 7 Drawing Sheets

TWO-STEP ROLLER FINGER CAM FOLLOWER HAVING SPOOL-SHAPED LOW-LIFT ROLLER

RELATIONSHIP TO OTHER APPLICATIONS AND PATENTS

This application claims the benefit of U.S. Provisional Application, Serial No. 60/359,744, filed Feb. 26, 2002.

TECHNICAL FIELD

The present invention relates to roller finger followers used in overhead cam type internal combustion engines, and more particularly to a roller finger follower wherein a spool-shaped roller set is used.

BACKGROUND OF THE INVENTION

Roller Finger Followers (RFF) are widely used in overhead cam internal combustion engines to sequentially open and close the cylinder intake and exhaust valves. In a typical application, the RFF serves to transfer and translate rotary motion of a cam shaft lobe into a pivotal motion of the RFF to thereby open and close an associated valve.

It is known that, for a portion of the duty cycle of a typical multiple-cylinder engine, the performance load can be met by a functionally smaller engine having fewer firing cylinders, and that at low-demand times fuel efficiency can be improved if one or more cylinders of a larger engine can be withdrawn from firing service. It is also known that at times of low torque demand, valves may be opened to only a low lift position to conserve fuel, and that at times of high torque demand, the valves may be opened wider to a high lift position to admit more fuel. It is known in the art to accomplish this by de-activating a portion of the valve train associated with pre-selected cylinders in any of various ways. One way is by providing a special two-step RFF having an activatable/deactivatable central slider arm which may be positioned for contact with a high lift lobe of the cam shaft. Such a two-step RFF typically is also configured with rollers disposed at each side of the slider arm for contact with low lift lobes of the cam shaft. Thus, the two-step RFF causes low lift of the associated valve when the slider arm of the RFF is in a deactivated position, and high lift of the associated valve when the slider arm of the RFF is in an activated position to engage the high lift lobe of the cam shaft.

A two-step RFF known in the art comprises a generally elongate body having a pallet end in contact with an axially movable valve stem and an opposing socket end in contact with a stationary pivot such as, for example, a hydraulic lash adjuster (HLA). A moveable and therefore deactivatable high lift slider is positioned central to the RFF body. Rollers are rotatably mounted on each side of the slider on a non-rotatable shaft fixed to the body. The rollers ride on narrow bearings, as for example needle bearings. End washers are used to rotatably fix the rollers and bearings to the shaft and to restrain the rollers and bearings from moving laterally on the shaft.

The width of the bearings in the background art is limited to the width of the rollers themselves. Further, because the bearings are disposed outside the body side walls, the bearings are substantially shielded from flow of lubricating oil within the RFF body.

It is a principal object of the present invention to provide an improved roller bearing arrangement for better durability without substantially increasing the overall width of the RFF.

It is also an object of the invention to provide a simplified RFF having fewer components.

While this invention is described in the context of a two-step deactivation RFF, it should be understood that the bearing improvements may be applied to the rollers of single-step RFFs as well.

SUMMARY OF THE INVENTION

Briefly described, a roller finger follower for use in conjunction with a cam shaft of an internal combustion engine comprises an elongate body having first and second side members defining coaxially disposed shaft orifices. A pallet end and a socket end interconnect with the first and second side members to define a slider arm aperture and a latch pin channel. The socket end is adapted to mate with a mounting element such as an hydraulic lash adjuster, and the pallet end is adapted to mate with a valve stem, pintle, lifter, or the like. A slider arm for engaging a high-lift cam lobe is disposed in the slider arm aperture and has first and second ends, the first end of the slider arm being pivotally mounted to the pallet end of the body and the second end defining a slider tip for engaging an activation/deactivation latch. The latch is slidably and at least partially disposed in the latch pin channel, the latch pin having a nose section for selectively engaging the slider tip. A spool-shaped roller comprising a shaft and at least one roller element fixedly attached to the shaft is rotatably disposed in the shaft orifices, the roller being adapted to follow the surface motion of a low-lift cam lobe. Preferably, the shaft is journalled in roller or needle bearings which extend between and through both the first and second shaft orifices, being thus exposed to normal copious oil flow through central regions of the RFF.

BRIEF DESCRIPTION OF THE DRAWINGS

The present invention will now be described, by way of example, with reference to the accompanying drawings in which.

DESCRIPTION OF THE PREFERRED EMBODIMENT

Figure 1:
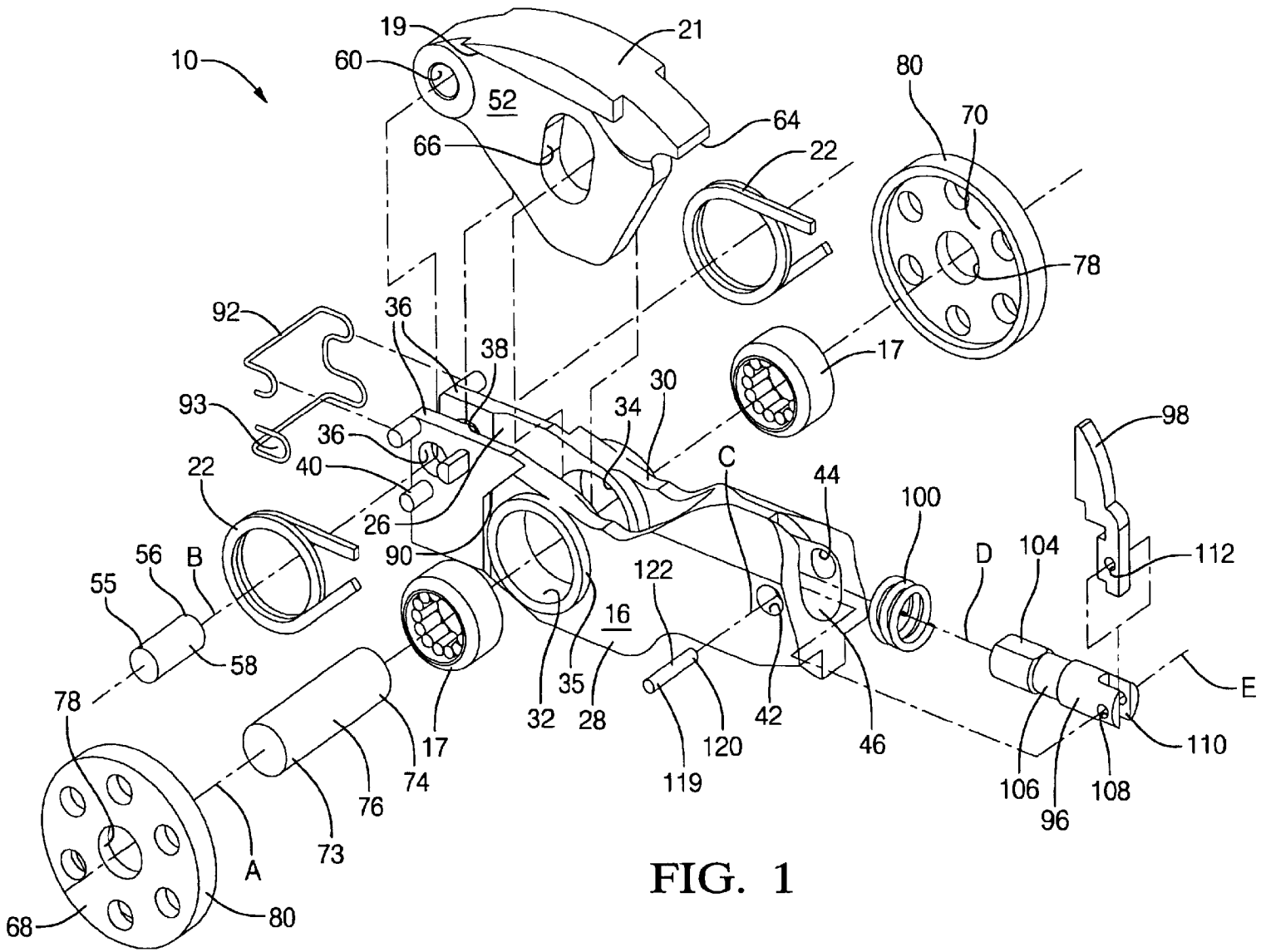
FIG. 1 is an exploded isometric view of a first embodiment of an RFF in accordance with the present invention.
Figure 2:
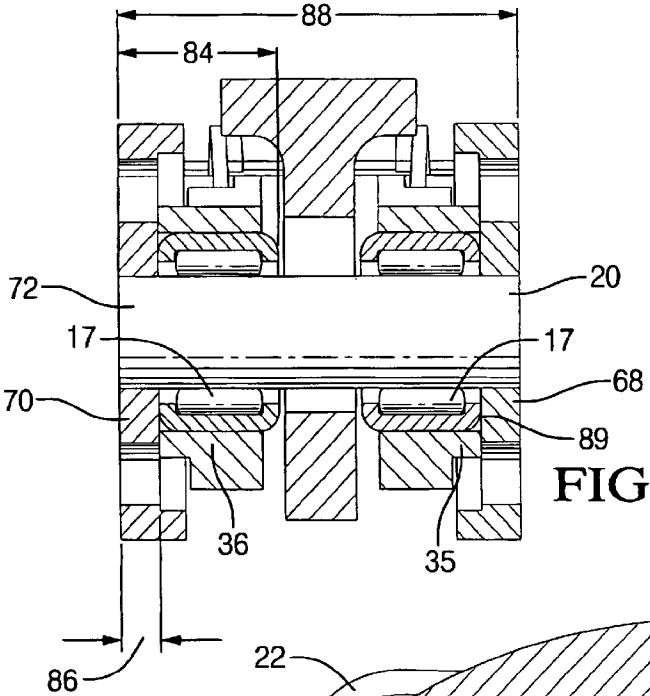
FIG. 2 is a cross-sectional view of the RFF taken through center axis A in FIG. 1.
Figure 3:
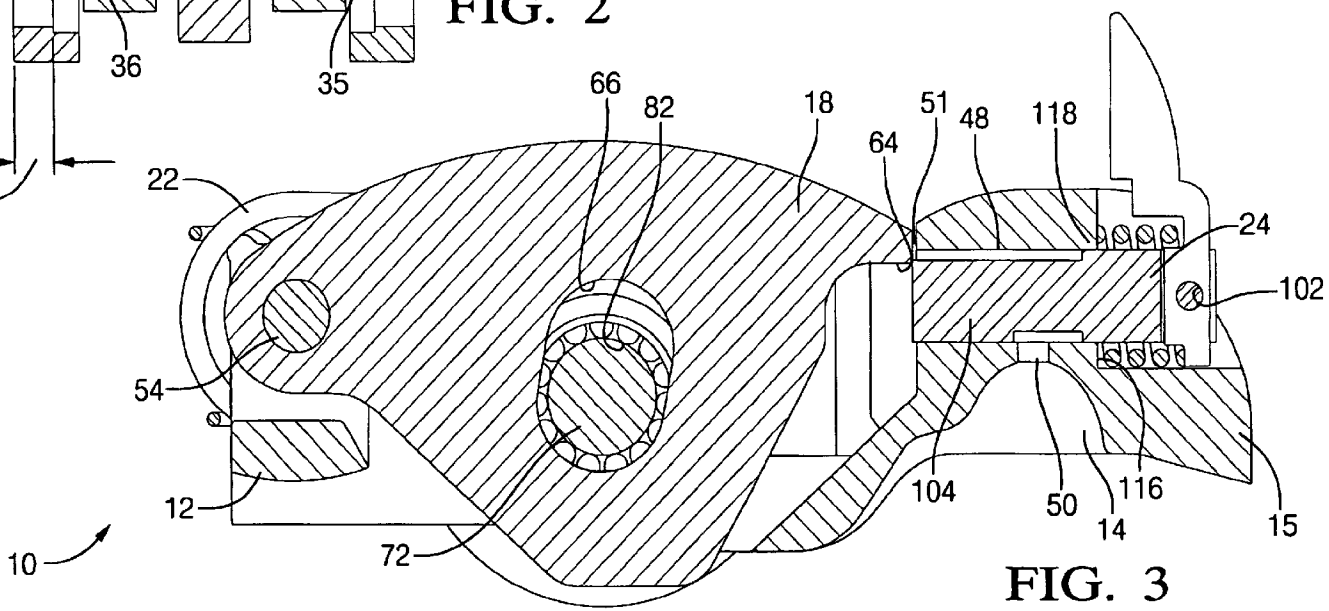
FIG. 3 is a cross-sectional view of the RFF taken through center axis D in FIG. 1.

Referring to FIGS. 1, 2, 3, and 6, improved RFF 10 is shown. A pallet end 12 of RFF 10 engages valve stem 11 and socket end 14 of RFF 10 engages lash adjuster 13. RFF 10 includes body assembly 15 (FIG. 3), slider arm assembly 18 (FIG. 3), spool roller assembly 20 (FIG. 2), lost motion springs 22 (FIGS. 1 and 3), and latch assembly 24 (FIG. 3).

Body assembly 15 includes elongate body 16 and roller bearings 17. Roller bearings 17, while shown in FIG. 1 as a needle bearing type, can be of any bearing type known in the art. Elongate body 16 includes slider arm aperture 26 bounded by body side walls 28,30. Body side walls 28,30 define shaft orifices 32,34 therethrough and bearing flanges 35. Each of shaft orifices 32,34 is concentric with center axis A. The diameters of shaft orifices 32,34 are sized to press fittedly receive roller bearings 17 which preferably are identical. Body side walls 28,30 further define slider arm shaft apertures 36,38 therethrough. Each of shaft apertures 36,38 is concentric with center axis B. Center axis A is substantially parallel with center axis B. Body side walls 28,30 proximate pallet end 12 of body 16, further define lost motion spring lugs 40 located circumferentially around slider shaft apertures 36,38. Socket end 14 of body 16 defines latch pin clearance orifice 42,44 and latch channel 46. Each of latch pin clearance orifice 42,44 is concentric with center axis C. Latch channel 46 is concentric with center axis D. Center axis C is substantially parallel with center axes A and B; center axis D is substantially perpendicular to center axes A, B and C. Socket end 14 of body 16 further defines oil passage 48 adjacent and parallel to latch channel 46 and in communication with oil orifice 50 (FIG. 3). As is described more particularly later, lubricating oil received under pressure from the HLA is fed through oil passage 48 and directed at slider arm assembly 18 which will now be described.

Slider arm assembly 18 includes slider arm 52 and slider shaft 54. Shaft 54 includes outer ends 55,56 and central portion 58. Slider arm 52 defines slider shaft orifice 60, slider surface 21, slider tip 64, and roller shaft clearance aperture 66. The diameter of slider shaft orifice 60 is sized to press-fittedly receive central portion 58 of shaft 54. In turn, the diameter of slider shaft apertures 36,38 in body 16 are sized to receive outer ends 55,56 of shaft 54 in a loose fit arrangement. Thus, shaft 54 is free to rotate in slider shaft apertures 36,38 but not free to rotate in slider shaft orifice 60. As a result, when assembled into slider arm aperture 26, slider arm assembly 18 is free to rotate about central axis B with relative motion only between slider shaft 54 and apertures 36,38 of body 16.

As best shown in FIGS. 1 and 2, spool-shaped roller assembly 20 includes spaced apart roller elements 68, 70 and roller shaft 72. Roller shaft 72 includes outer ends 73,74 and central portion 76. Roller elements 68, 70 define internal diameter 78, and outer diameter 80. Internal diameter 78 of rollers 68, 70 is sized to press-fittedly receive outer ends 73, 74 of shaft 72. It is understood that the roller elements could also be loosely received on outer ends 73,74 and, for example, be welded, bonded, or staked to the shaft, or fixedly attached to the shaft by any other means known in the art. When assembled to the shaft, the outside end surfaces of roller elements 68, 70 are substantially flush with end surfaces of shaft 72. Internal diameter 82 of roller bearings 17 is sized to rotatably receive shaft 72. Thus, roller bearings 17 are free to rotate about the shaft in an essentially friction free manner as known in the art.

Therefore, as best shown in FIG. 2, when assembled into body assembly 15, roller elements 68, 70 and shaft 72 rotate as an integral spool-shaped unit within roller bearings 17. Since the bearings are mounted inboard of the roller elements, the bearing width is not limited to the width of the roller elements as in the prior art. In fact, as can be readily seen in FIG. 2, width 84 of the bearings is almost three times the width 86 of rollers 68,70 without increasing the overall width 88 of the RFF assembly. Further, since end washers are not needed to secure the roller elements to the shaft ends as in the prior art, even wider bearings could be used without increasing the overall width of the RFF assembly. Moreover, in the prior art, where the end washers and the walls of the RFF body serve as lateral thrust surfaces for the rollers, bearing shoulders 89 or bearing flanges 35 serve as lateral thrust surface of the present invention. As is discussed more thoroughly below, the thrust surfaces of the present invention are well lubricated to reduce friction and wear.

Figure 5:
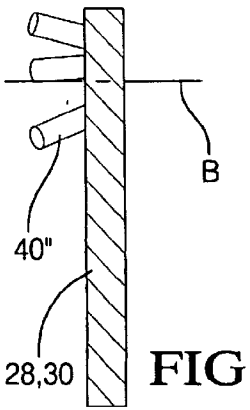
FIG. 5 is a side view of the lost motion spring lugs of a third embodiment.
Figure 4:
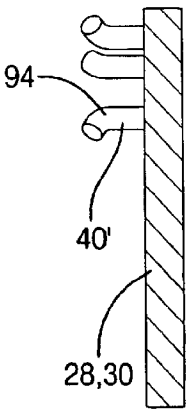
FIG. 4 is a side view of the lost motion spring lugs of a second embodiment.

Referring again to FIG. 1, lost motion springs 22 are coiled around outer ends 55,56 of slider shaft 54 to abuttingly engage spring stop 90 on body 16 and the underside 19 of slider surface 21. Each of lost motion springs 22 is guided centrally about central axis B by at least one of lost motion spring lugs 40 extending from each of walls 28,30. Retainer clip 92 having at least one end wrap 93 loops around at least one of spring lugs 40 to secure lost motion springs 22 laterally in place. As aternate embodiments for securing the lost motion springs in place, end hooks 94 can be formed on the ends of the spring lugs 40' (FIG. 4) or lugs 40" can be formed to axially diverge away from central axis B (FIG. 5) without the need for retainer spring 92. When assembled to RFF 10, each of lost motion springs 22 applies a bias force to slider arm assembly 18 in the counter clockwise direction (as viewed in FIG. 3).

Latch assembly 24 includes substantially cylindrical latch 96, contact paddle 98, spring 100, and latch pin 102. Latch 96 further defines flattened nose section 104 and reduced diameter section 106. Nose section 104 is configured to selectively engage slider tip 64 and reduced diameter section 106 is formed to facilitate the passage of oil from orifice 50 to oil passage 48 for lubricating slider surface 21 of slider arm 52. Latch 96 is sized to slidably fit into latch channel 46. Latch 96, opposite nose section 104, defines latch pin orifice 108 and slot 110 for receiving contact paddle 98. A similarly sized orifice 112 is disposed in contact paddle 98 such that, when paddle 98 is received in latch slot 110, orifices 108 and 112 are aligned co-axially. Bias spring 100, configured as, for example, a coil spring, is positioned around cylindrical latch 96, and abuttingly engages spring stop 116 in body 16 when latch assembly 24 is assembled into latch channel 46. The other end of spring 100 engages latch pin 102 so as to bias latch assembly 24 in the outward (FIG. 3) or slider-disengaged position. The assembly of latch pin assembly 24 into body assembly 15 will now be discussed.

Latch pin 102 includes ends 119,120 and central section 122. The diameter of latch pin 102 at central section 122 is sized to be press-fittedly received by at least one of orifices 108,112. Center axis C of latch pin clearance orifices 42, 44 in body 16 is generally co-axial with the center axis E of orifices 108,112 when latch assembly 24 is positioned in RFF 10 as shown in FIG. 3. When assembled in this fashion, central section 122 of pin 102 is inserted into orifices 108,112 such that ends 119,120 of pin 102 extend at least partially into clearance orifices 42,44. Since the diameter of latch pin clearance orifices 42,44 is substantially larger than the diameter of latch pin 102 at pin ends 119,120, the size of orifices 42,44 relative to the diameter of pin ends 119,120 control the left/right, engagement/disengagement travel of latch assembly 24. Thus, when assembled into RFF 10, pin 102 serves multiple purposes including (1) providing a seat for spring 100; (2) fixing paddle 98 to latch 96; (3) limiting the leftward (FIG. 3) travel of latch 96; and (4) limiting the rightward (FIG. 3) travel of latch 96.

Referring now to FIG. 3, RFF assembly 10 is shown in the slider-disengaged mode. Latch assembly 24 is in its full rightward position. Nose section 104 of latch 96 is not in engagement with slider tip 64 of slider arm 52. In this mode, as best described with reference to FIG. 6, the rotary motion of low lift cam lobes 132 of cam shaft 130 is translated by roller elements 68, 70 into a pivoting movement of RFF 10 about lash adjuster 13 thereby providing a low-lift opening of the associated valve. Since slider arm assembly 18 is disengaged from the latching mechanism, the rotary motion of high lift cam lobe 134 imparted on slider arm 52 is absorbed by lost motion springs 22 and is not translated by slider arm 52 into a pivoting movement of RFF 10. In this mode (disengaged position), the entire cam surfaces of the low lift cams, including low lift lobes 132 and base circles 133 of the low lift cams remain in contact with roller elements 68, 70 through the full rotation of the cam shaft. Further, because of the action of lost motion springs 22 on slider arm assembly 18, the entire surface of the high lift cam, including high lift lobe 134 and base circle 135 of high lift cam, remains in contact with slider surface 21 to maintain a film of oil between the cam surface and the slider surface. Note in FIG. 3 that roller shaft clearance aperture 66 in slider arm 52 is sized to provide sufficient clearance to roller shaft 72 to permit full travel of slider arm assembly 18 as described above.

Figure 6:
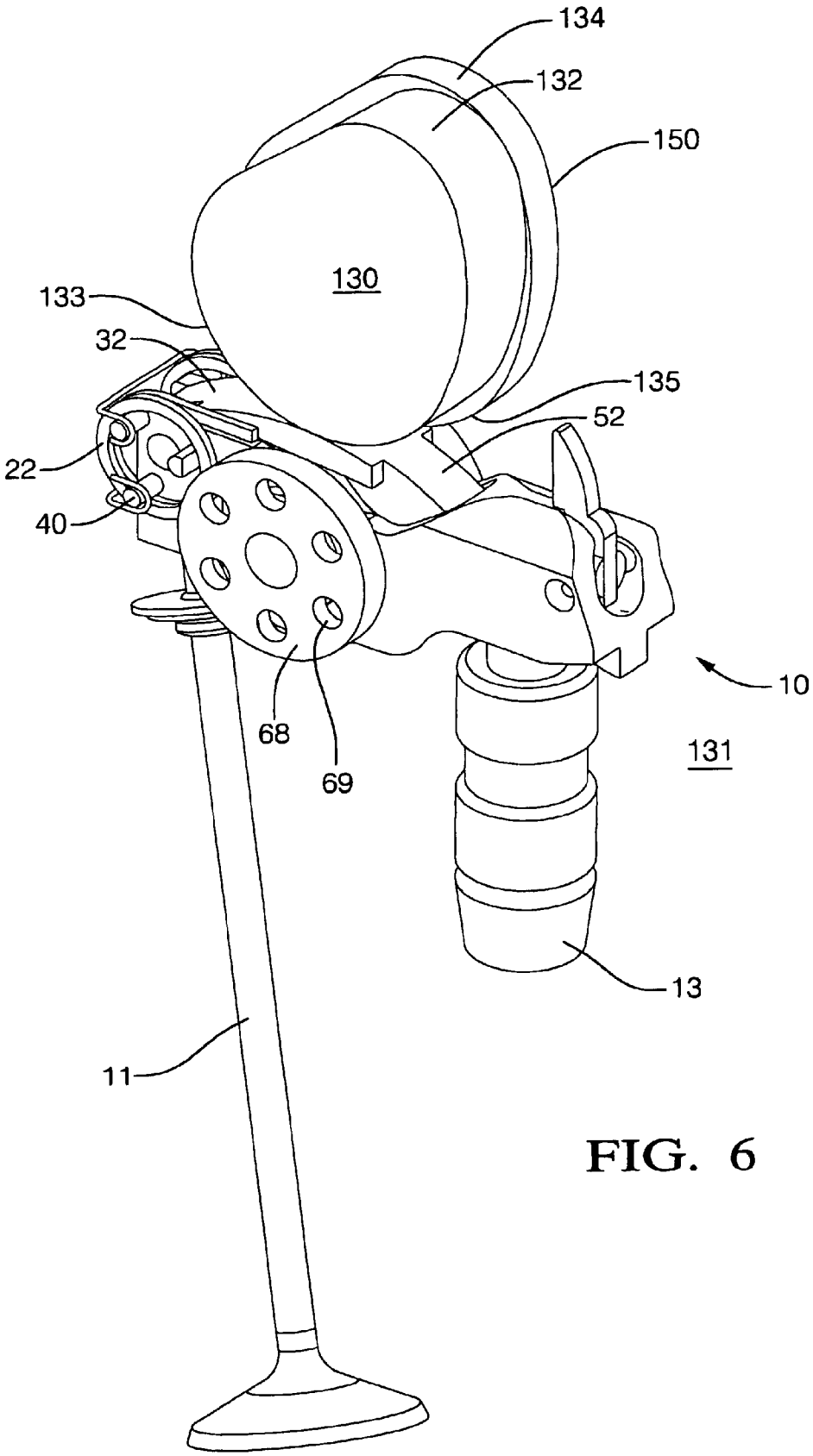
FIG. 6 is a perspective view of the RFF, cam shaft, valve and HLA.
Figure 7:
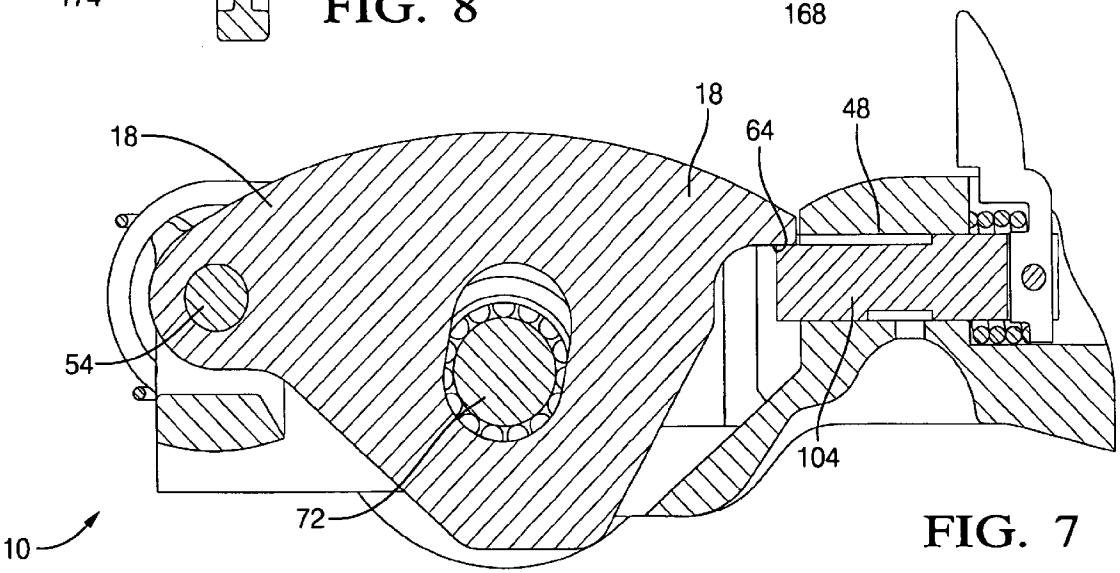
FIG. 7 is a cross section view of the RFF similar to FIG. 3, but with the slider engaged.

FIG. 7 shows RFF 10 in the slider-engaged mode. In this mode, the rotary motion of high lift cam lobes 134 of cam shaft 150 of internal combustion engine 131 is translated by slider arm assembly 18 into a pivoting movement of RFF 10 about lash adjuster 13 thereby providing a high-lift opening of the associated valve. Referring to FIGS. 6 and 7, since the slider is engaged, the rotary motion of high lift cam lobe 134 is not absorbed by lost motion springs 22 and is therefore transferred by slider arm 52 to a pivoting movement of RFF 10. In this mode (engaged position), while the lobed portions 132 of the low lift cams do not contact roller elements 68, 70, base circle portions 133 of the low lift cams do. Thus, when in the slider-engaged position, for each revolution of cam shaft 130, base circle 133 of the low lift cams first engage the roller elements, then disengage the roller elements when the high lift cam lobe 134 comes in contact with engaged slider arm 52. This high frequency cyclic load placed on the spool-shaped roller by the low lift cams can increase wear on the roller element surfaces. Lightener holes 69 extending laterally through the roller elements serve to reduce the rotational mass of the roller elements to reduce inertia and wear.

Figure 8:
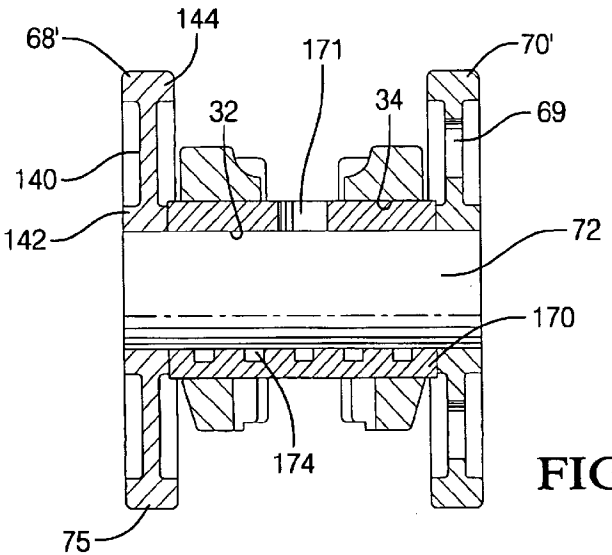
FIG. 8 is a cross-sectional view taken through center axis A showing rollers of an alternate embodiment.

Roller elements 68', 70' of an alternate embodiment having an "I-beam" shaped cross section are shown in FIG. 8, comprising a web 140, hub 142, and rim 144. Like the lightening holes, the I-beam shaped cross section serves to reduce the rotational mass of the rollers to reduce inertia and wear. As shown in FIG. 8, roller elements 68', and 70' may also have lightening holes 69 to offer a further mass reduction.

Figure 9A:
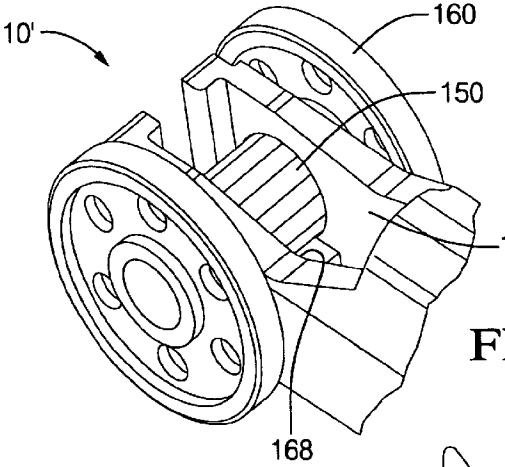
FIG. 9*a* is a perspective view showing the bearings of an alternate embodiment.
Figure 9B:
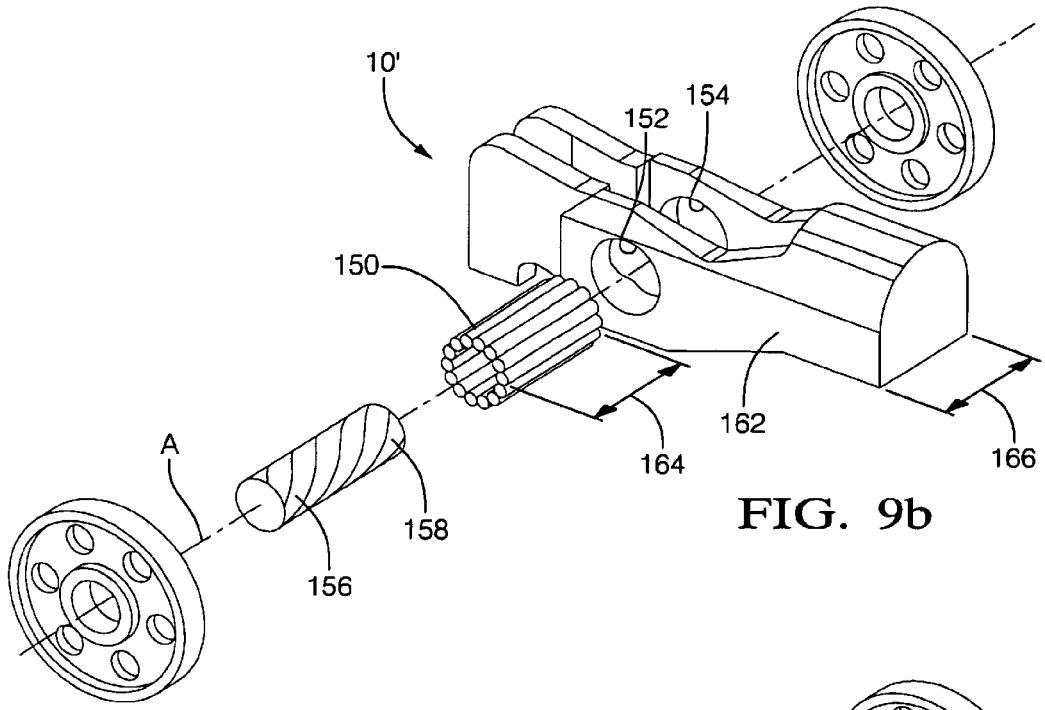
FIG. 9*b* is an exploded view of FIG. 9*a;*

RFF 10 as described herein uses split bearings 17 in the preferred embodiment. Bearings 17 are shown in FIG. 1 as needle bearings. In an alternate embodiment, rather than split bearings, RFF 10' uses a full width set of needle bearings. As shown in FIGS. 9*a* and 9*b*, the outer and inner diameters of long needle bearing set 150 are sized diametrically to fit into bearing orifices 152,154 and to fit around the diameter of shaft 156 so that, when spool roller assembly 160 and bearing set 150 are installed in elongate body 162, the spool roller assembly is free to rotate about center axis A in an essentially friction free manner as known in the art. Width 164 of long needle bearing set 150 is substantially the same or slightly less than width 166 of body 162. Thus, bearing flanges, as shown as numeral 35 in FIG. 1, provide lateral thrust surfaces to the rollers. In this embodiment, long needle bearing set 150 is supported by the thicknesses of body walls 28,30. However, it is understood that bottom surface 168 (shown in FIG. 9*a*) of elongate body 162 can be formed to provide central support to long needle bearing set 150.

In yet another embodiment (FIG. 8), the long needle bearing set can be replaced by bearing sleeve 170 that is either press fitted into shaft orifices 32,34 or loose fitted into orifices 32,34 to provide a low friction contact between roller shaft 72 and elongate body 162. When press-fitted, bearing sleeve 170 offers additional stiffness to elongate body 162 to resist bending from the forces applied to the RFF by the rotating cam shaft.

Figure 9C:
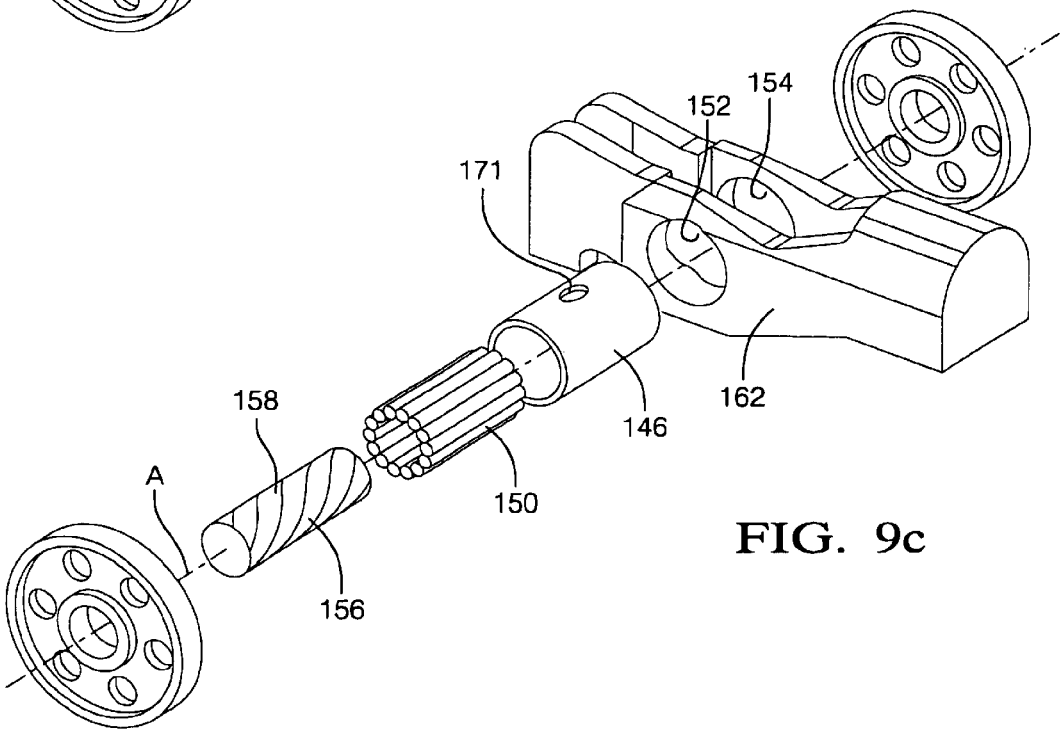
FIG. 9*c* is an exploded view of a variation of the embodiment shown in FIGS. 9*a* and 9*b;*

In yet a further embodiment, the long needle bearing set as shown in FIGS. 9*a* and 9*b* can be modified to include outer tube 146 (FIG. 9*c*). In this embodiment, the outer diameter of tube 146 is sized to be press fit into bearing orifices 152,154 while the inner diameter of tube 146 is sized to receive the outer diameter of long needle bearing set 150. In turn, the outer diameter of shaft 156 is sized to fit inside the inner diameter of bearing set 150 so that, once all of the components are assembled in this manner, the spool roller assembly is free to rotate about center axis A, relative to body 162, in an essentially friction free manner as known in the art. The widths of tube 146 and long bearing set 150 are substantially the same or slightly less than width of body 162 so that bearing flanges 35, as shown in FIG. 1, provide lateral thrust surfaces to the rollers. In this embodiment, tube 146 provides central support to bearing set 150 and rigidity to body 162.

Lubrication to RFF 10 and its components is improved by the present invention. As discussed above, lubricating oil is fed directly to slider surface 21 by oil passage 48 in elongate body 16. Oil passage 48 is in fluid communication with orifice 50 which receives lubricating oil, under pressure, from the HLA. Lubricating oil flows through orifice 50, around cylindrical latch 96 and within latch channel 46, into oil passage 48 which is in fluid communication with channel 46. Opening 51 (FIG. 3) extending from passage 48 directs a stream of oil at slider surface 21 and the outer surfaces of rollers 68,70. Lubricating oil from slider surface 21 drips down into slider arm aperture 26 where it pools around shaft 72 and flows directly into roller bearings 17.

Figure 10:
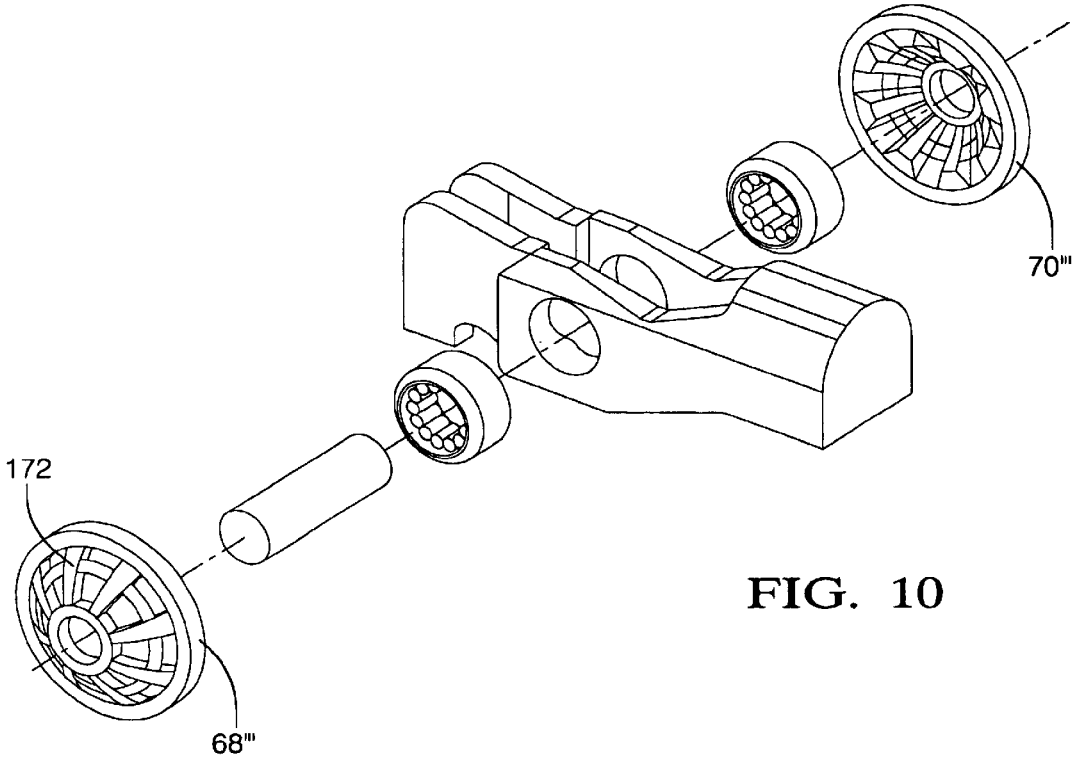
FIG. 10 is an exploded view similar to FIG. 9*b* showing rollers of yet another embodiment.

In an alternate embodiment, in place of lightener holes 69, air foil blades 172 are disposed through roller elements 68",70" (FIG. 10) that serve both to reduce the rotational mass of the roller elements as discussed above, and to pull in and direct lubricating oil toward bearings 17, from the surrounding environment. Thus, every frictional surface within RFF 10 is positively and copiously engulfed in lubricating oil. Regarding the alternate embodiment wherein long needle bearing set 150 is used (FIG. 9*b*), roller shaft 156 further defines spiral oiler groove 158 in its surface. Lubricating oil drips into slider arm aperture 26 as described above and is pulled through the long needle bearings toward shaft 156 by the rotation of the needle bearings in use. Spiral oiler groove 158 serves to transport lubricating oil across the surface of shaft 156 and toward roller elements 68,70.

Regarding the alternate embodiment wherein bearing sleeve 170 is used (FIG. 8) or where tube 146 is used in conjunction with long needle bearing set 150 (FIG. 9*c*), oiler aperture 171 extends through the wall of sleeve 170 or through the wall of tube 146 to fluidly communicate slider arm aperture 26 with the surface of shaft 156 and oiler groove 158. Thus, ample lubricating oil is positively fed inside sleeve 170 to lubricate it, the surface of shaft 156 and roller elements 68, 70.

In yet a further alternate embodiment, the inside surface of sleeve 170 defines the spiral oiler groove 174. In the same way as described above, lubricating oil is transported by the groove across the surface of the roller shaft toward roller elements 68, 70.

In the background art, lubricating oil is not directed toward slider surface 21 by an integrated oil passage similar to passage 48. Moreover, because the roller elements and roller bearings are mounted to roller shafts outside the roller body, the walls of the roller body detrimentally shield the bearings and rollers from being lubricated from oil pooled inside the body.

Figure 11A:
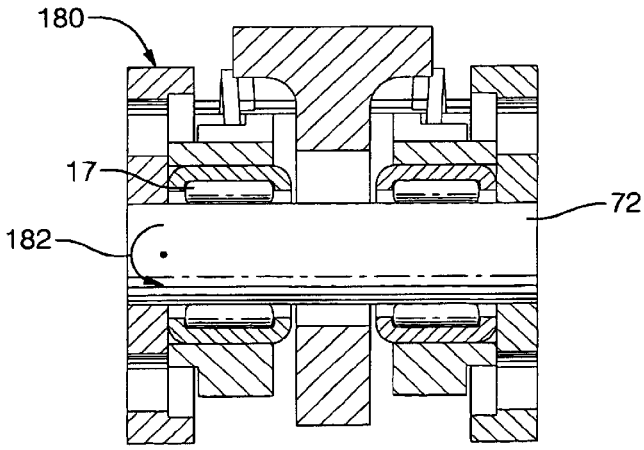
FIGS. 11*a* and 11*b* are cross sectional views taken through axis A showing forces exerted on the bearings by the rollers.
Figure 11B:
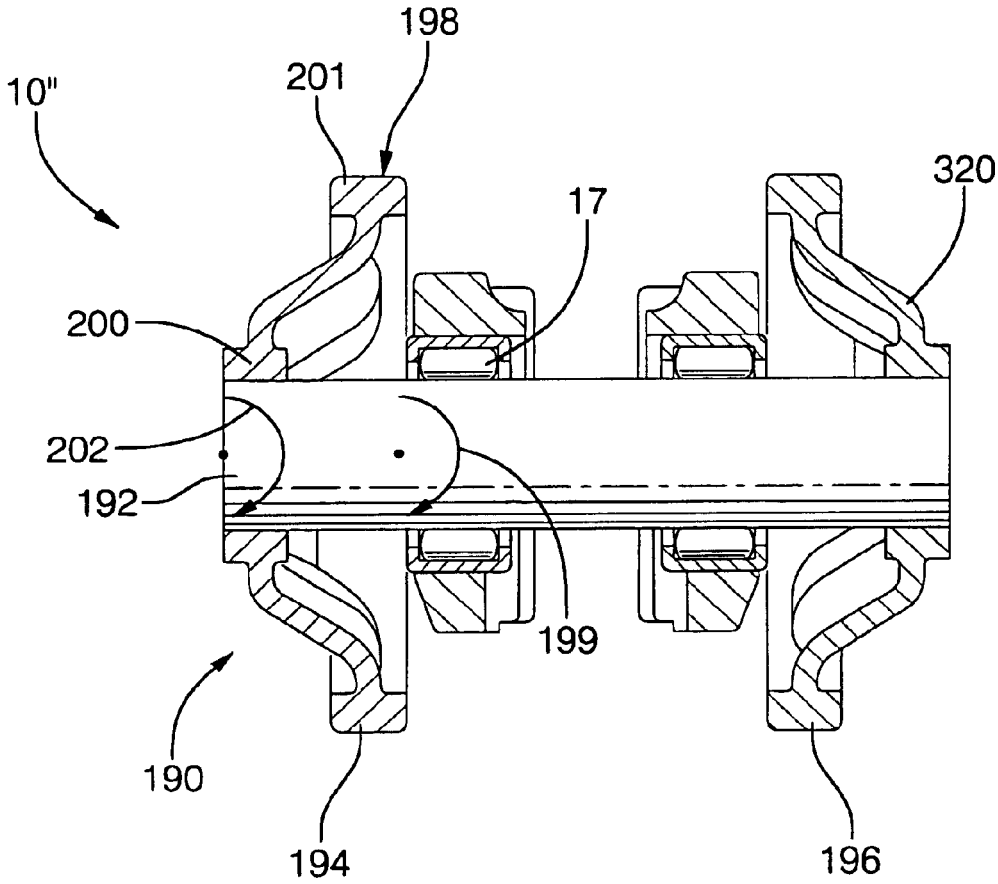

Referring to FIG. 11*a*, the load forces directed toward shaft 72 and split bearings 17 of the present invention are shown. As can be seen, downward force 180 from the low lift cam lobe induces counter clockwise bending moment 182 on the shaft near the outermost edge of bearing 17. Edge loading is high at this point which may cause unfavorable wear to the shaft/bearing edge juncture. A portion of RFF 10" of an alternate embodiment is shown in FIG. 11*b*. Spool roller assembly 190 includes roller shaft 192 and roller elements 194,196. Bearing 17 and the portion of body 16 shown are substantially identical to equivalent components of RFF 10. Downward force 198 from the low lift cam lobe induces counter clockwise bending moment 199 on the shaft near the outermost edge of bearing 17. In addition, because of hub 200 being offset from contact surface 201 of roller elements 194,196, downward force 198 induces a clockwise bending moment 202 on the outboard end of shaft 192. The counter directional moments caused by the offset hub serve to reduce the magnitude of the resulting edge loading at the shaft/bearing edge juncture and thus reduce friction and unfavorable wear at the juncture.

What is claimed is:

1. A roller finger follower for use in conjunction with a cam shaft of an internal combustion engine, said roller finger follower comprising:

a) an elongate body having a first side wall and a second side wall, said walls defining coaxially disposed shaft orifices, a pallet end and a socket end interconnecting with said first and second side members to define a slider arm aperture, and a latch channel;

b) a slider arm disposed in said slider arm aperture for engaging a first cam lobe of said cam shaft, said slider arm having a first end and a second end, said first end of said slider arm being pivotably mounted to said pallet end of said body, and said second end defining a slider tip;

c) a latch assembly slidably and at least partially disposed in said latch channel, and including a latch having a nose section for selectively engaging said slider tip; and d) a spool roller assembly having a shaft and at least one roller element for engaging a second cam lobe, said roller element being fixedly attached to said shaft, said shaft of said spool roller being rotatably disposed in said shaft orifices.

2. A roller finger follower in accordance with claim 1 further comprising at least one bearing disposed coaxially with and between said shaft and both of said shaft orifices.

3. A roller finger follower in accordance with claim 2 wherein said at least one bearing includes split bearings.

4. A roller finger follower in accordance with claim 2 wherein said at least one bearing includes needle bearings.

5. A roller finger follower in accordance with claim 4 further including an outer tube disposed coaxially with and between needle bearings and both of said shaft orifices.

6. A roller finger follower in accordance with claim 2 wherein said at least one bearing includes a sleeve bearing.

7. A roller finger follower in accordance with claim 6 wherein said sleeve bearing includes an oil aperture therethrough.

8. A roller finger follower in accordance with claim 7 wherein said shaft includes a spiral oiler groove.

9. A roller finger follower in accordance with claim 7 wherein said sleeve has an inside surface further defining a spiral oiler groove.

10. A roller finger follower in accordance with claim 1 wherein said elongate body further includes an oil passage for transferring oil to a slider surface of said slider arm.

11. A roller finger follower in accordance with claim 1 wherein said at least one roller includes at least one lightener hole extending laterally therethrough.

12. A roller finger follower in accordance with claim 1 wherein said at least one roller includes a cross-section formed in an I-beam shape.

13. A roller finger follower in accordance with claim 1 wherein said at least one roller includes at least one air foil blade.

14. A roller finger follower in accordance with claim 1 wherein said at least one roller includes a hub and a contact surface, said hub being offset from said contact surface.

15. A roller finger follower in accordance with claim 1 wherein said elongate body further includes at least one latch pin clearance orifice, said orifice having a first diameter, said latch including a latch pin having a second diameter, wherein said latch pin is disposed at least partially in said at least one latch pin clearance orifice and said first diameter is larger than said second diameter.

16. A roller finger follower in accordance with claim 1 further including at least one lost motion spring and means for securing said at least one lost motion spring to said elongate body.

17. A two-step roller finger follower for use in conjunction with a cam shaft of an internal combustion engine, the camshaft having high-lift and low-lift cam lobes, the roller finger follower comprising:

a) an elongate body having a first side wall and a second side wall, said walls defining coaxially disposed shaft orifices, a pallet end and a socket end interconnecting with said first and second side members to define a slider arm aperture, and a latch pin channel;

b) a slider arm disposed in said slider arm aperture for engaging said high-lift cam lobe, said slider arm having a first end and a second end, said first end of said slider arm being pivotably mounted to said pallet end of said body, and said second end defining a slider tip;

c) a latch assembly slidably and at least partially disposed in said latch channel, and including a latch having a nose section for selectively engaging said slider tip; and d) a spool roller assembly including a shaft and first and second roller elements fixedly attached to said shaft for engaging said low-lift cam lobes, said shaft of said roller assembly being rotatably disposed in said shaft orifices.

* * * * *